United States Patent [19]

Lyss

[11] 4,432,300

[45] Feb. 21, 1984

[54] PILL DISPENSER WITH SEQUENTIAL DISPENSING AND INDICATING CAP

[76] Inventor: Esther B. Lyss, 722 S. Meramec, St. Louis, Mo. 63105

[21] Appl. No.: 268,782

[22] Filed: Jun. 1, 1981

[51] Int. Cl.[3] ..... B65D 83/56; G09F 9/00

[52] U.S. Cl. ..... 116/308; 206/534; 206/538; 221/4; 221/91

[58] Field of Search ..... 116/307, 308; 206/533, 206/534; 220/284

[56] References Cited

U.S. PATENT DOCUMENTS

| | | | |
|---|---|---|---|
| 2,111,637 | 3/1938 | Mehaffey | 116/308 |
| 2,252,487 | 8/1941 | Bevill | 116/308 |
| 3,151,599 | 10/1964 | Livingston | 206/534 X |
| 3,227,127 | 1/1966 | Gayle | 116/308 |
| 3,302,775 | 2/1967 | Finkelston, Jr. et al. | 221/4 |
| 3,326,360 | 6/1967 | Lyon | 206/533 |
| 3,355,067 | 11/1967 | Espinal | 206/534 X |
| 3,557,747 | 1/1971 | Rigney | 116/308 |
| 3,570,707 | 3/1971 | Finkel | 221/5 |
| 3,572,282 | 3/1971 | Tump et al. | 116/308 |
| 3,678,884 | 7/1972 | Robbins | 116/308 |
| 3,800,940 | 4/1974 | Thomas | 206/534 X |
| 3,911,856 | 10/1975 | Ewing | 116/308 X |
| 4,011,829 | 3/1977 | Wachmann | 116/308 |
| 4,046,168 | 9/1977 | Milne | 220/306 X |
| 4,164,301 | 8/1979 | Thayer | 221/91 X |
| 4,346,815 | 8/1982 | Raymor et al. | 220/306 |

*Primary Examiner*—Daniel M. Yasich

*Attorney, Agent, or Firm*—Glenn K. Robbins

[57] ABSTRACT

A pill dispenser having a rotatable cap with special opening means for dispensing a pill at the proper time for medication. The dispenser comprises a housing having openings corresponding to each time for medication in a repetitive cycle such as in a day or week. A rotatable indicator cap or lid has means cooperating with the housing to provide by a detent means stagewise movement and in a modification ratchet means for one way rotation. An opening in the cap is provided for view of indicia means on the top of the housing with a selected time for taking indicia. When the time for taking the pill arrives the cap is rotated to present a dispensing opening in registry with one of the housing openings for dispensing a pill. The indicator cap and a bottom fill cap may be press fitted on the bottle housing for simple fabrication and refilling the contents.

16 Claims, 22 Drawing Figures

PILL DISPENSER WITH SEQUENTIAL DISPENSING AND INDICATING CAP

BACKGROUND OF THE INVENTION

In the past various types of pill dispensers have been provided for dispensing pills at regular intervals. It has long been a problem for the patient or pill user to remember with consistency the proper time for indication and proper dispensing of the pill. It has been a particular problem to provide a simple and easy to use small pill dispenser that can be employed by the sick and infirm and that can be safely used without the obvious dangers of failure to properly time the pill dispensing operation through under use or over use.

SUMMARY OF THE INVENTION

By means of this invention there has been provided a simply designed pill dispenser that can be employed in an easy and efficient fashion by the user in which a two stage operation is employed.

In the first stage the user turns the lid of the specially designed dispenser to present an opening in a cap or lid having an opening means registering with one of a plurality of openings in a housing of the dispenser to allow the dispensing of the pill. In the second stage the lid is turned to a visual indicia in the housing stating the next pill taking time and which may be viewed through the opening means of the cap. When that time arrives the user then repeats the cycle to dispense the pill and turn the cap to the next indicia for the next time of taking of the pill.

The pill dispenser is comprised of a housing having a top lid or cap which may be turned on top of the housing. In order to insure stagewise movement and rotation of the cap to the proper position a detent means is provided by a bead-like detent on the underside of the cap which is engageable selectively with one of a plurality of openings on the top wall of the housing to provide automatic registry of the opening means.

In a modification means to insure unidirectional movement, is provided. In this embodiment the cap has ratchet teeth engageable with the housing to provide this feature and ensure cyclic movement in a unidirectional progressive movement.

In order to provide the aforementioned two stage dispensing operation the cap is provided with an opening means comprised of a sight opening and an underlying top wall of the housing is provided with a series of indicia defining the pill taking period such as morning, noon, evening and night. The aforementioned indicia are imprinted in a circular fashion on the top wall of the housing to be exposed as the cap is turned in a clockwise manner.

The dispensing opening structure is comprised of a series of circumferential dispensing openings in the upper part or top of the housing. The opening means in the lid is provided for alignment with the dispensing openings as the cap is turned.

As the user turns the lid the openings are aligned and pills in the housing may be dispensed. The user then turns the lid to expose the next period for taking the pills. When that time arrives the user notes from the sight opening that the proper time has arrived and turns the lid to the dispensing position to dispense the pills. The cycle is thus completed and the user starts a new cycle by turning the lid to expose the next pill taking period indicia. An outside self adhesive label may be provided to indicate the proper dosage and medication periods.

Filling means are provided at the bottom of the housing which is open and is closed through a snap-on cap. Since the housing has a closed top wall the filling is provided at the bottom which also minimizes tampering with the top structure.

The pill dispenser may be simply fabricated from plastic to provide a rugged and inexpensive means for dispensing pills that can be used for a wide variety of time periods and conditions. Through the two stage turning structure and operation, infirm and users prone to be confused can use the dispenser with a minimum of complexity to ensure proper and timely use of the dispenser.

The above features are objects of this invention. Further objects will appear in the detailed description which follows and will be otherwise apparent to those skilled in the art.

For the purpose of illustration a preferred embodiment of the invention is shown in the accompanying drawing. It is to be understood that the drawings are for the purpose of example only and that the invention is not limited thereto.

IN THE DRAWING

DESCRIPTION OF THE INVENTION

Figure 1:
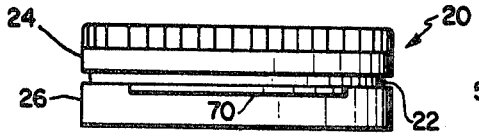
FIG. 1 is a view in side elevation of the pill box of this invention.

The pill dispenser of this invention is generally indicated by the reference numeral 20 in FIGS. 1, 3, 9, 10 and 12. It is comprised of a housing 22, a top cap 24 and a fill cap 26 constructed of plastic, metal or other standard materials of construction.

Figure 3:
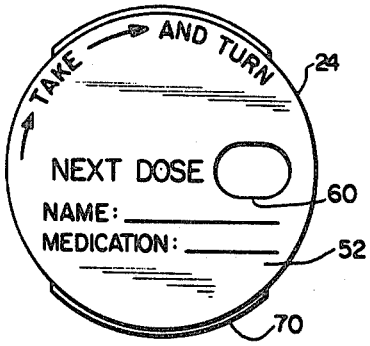
FIG. 3 is a top plan view of the pill box.
Figure 4:
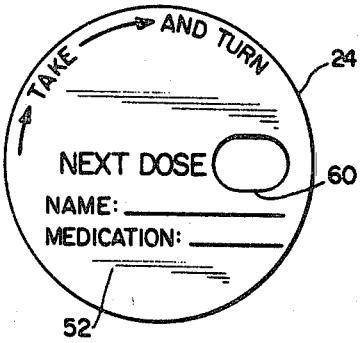
FIG. 4 is a top plan view of the cap.
Figure 5:
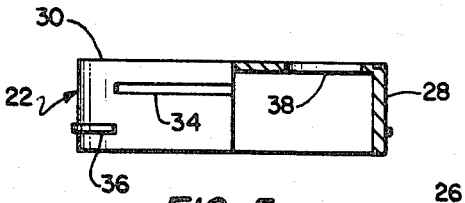
FIG. 5 is a full bodied view in side elevation of a left half of the housing with the right hand half being shown in vertical section on a radius of the housing.

The housing is best shown in FIGS. 3, 4 and 5 and is comprised of a short tubular side wall 28 having a closed top wall 30 and an open bottom 32 to provide easy access for filling.

The housing side wall has an upper bead 34 for press-fitting and securing of the cap as will appear more fully hereinbelow. A lower bead 36 is similarly provided to receive the bottom fill cap.

The top wall is further provided with a series of four circumferential openings 38 at a top portion of the housing. Each of the openings is associated with the period of time for dispensing the pills when the lid or cap is turned.

In order to provide for stagewise movement of the cap or lid upon the housing and facilitate the turning of the cap to the point where the openings are properly registered a detent means is provided. The detent means is comprised of a plurality of beads or tangs 39 which are arranged in a circumferential manner on the bottom of the turn cap 24. The beads are engageable in openings 40 arranged in a like circumferential manner upon the top of the housing as shown in FIG. 3. Due to the flexibility of the wall structure of the cap and the housing the turning of the cap upon the housing causes the detent beads to ride upon the top of the housing until registered in the next position as well shown in FIGS. 9 and 10.

Figure 11:
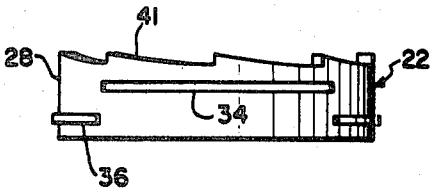
FIG. 11 is a view of a modified housing in side elevation having a ratchet structure.
Figure 12:
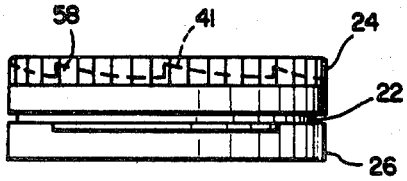
FIG. 12 is a view of the modified pill box in side elevation showing the engagement of underlying ratchet teeth on the underside of the cap with the ratchet structure on the top of the housing in dotted lines.
Figure 13:
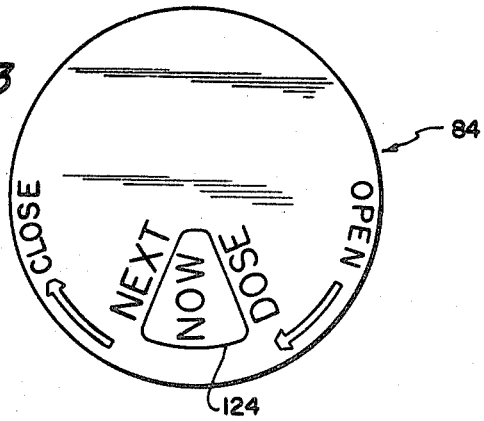
FIG. 13 is a top plan view of a further modified pill box.
Figure 14:
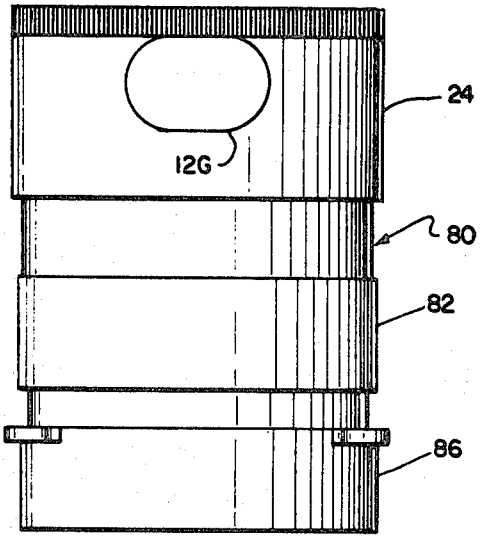
FIG. 14 is a view in side elevation of the modification of FIG. 13.
Figure 15:
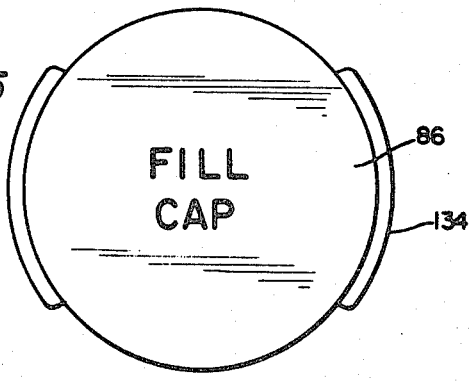
FIG. 15 is a bottom plan view of the modification of FIG. 13.

In another modification of the interfitting of the cap upon the housing unidirectional movement may be provided as shown in FIGS. 11 and 12.

In order to provide the one-way turning of the lid upon the housing a ring of ratchet teeth 41 is provided on the top wall. These ratchet teeth engage with ratchet teeth on the lid as will appear hereinbelow in FIGS. 11 and 12 to ensure that the lid may be turned only in a sequential clockwise manner through the time periods in the dosage cycle.

Figure 7:
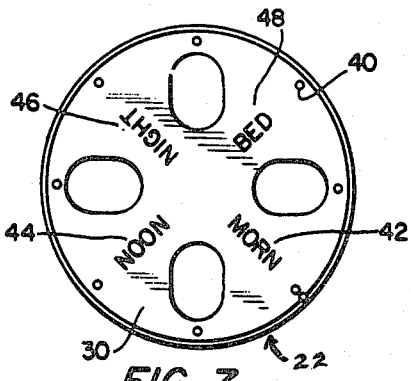
FIG. 7 is a top plan view of the cap.

The top wall of the housing has marked upon it as shown in FIG. 7 indicia corresponding to the time for taking and for purpose of example the indicia are indicated as MORN at 42, NOON at 44, NIGHT at 46 and BED at 48. Each of the indicia is positioned between adjacent openings 38. It will be understood that the number of openings in the housing and associated indicia may be varied in the fabrication of the housing depending on the number of pill taking periods in a complete cycle whether this be a day, week or month or the like.

Figure 2:
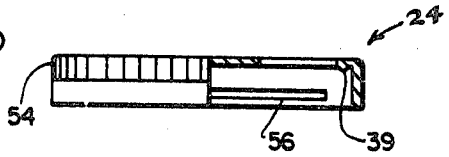
FIG. 2 is a full bodied view in side elevation of a left half of the pill box cap with the right hand half being shown in vertical section on a radius of the cap.

The turn cap 24 is best shown in FIGS. 2 and 4. It is comprised of a top wall 52 and a short downwardly depending side wall or skirt 54 which forms a loose fit over the top of the housing in order that rotation may be effected. An internal groove 56 is adapted to engage in the upper bead 34 of the housing to effect a snap-on or press-on fit.

In the modification of FIGS. 11 and 12 a ring of ratchet teeth 58 is formed on the underside of the top wall in registry and engageable with the ratchet teeth 41 of the housing. By means of this ratchet tooth engagement the cap may be easily turned unidirectionally in a clockwise direction in the pill dispensing operation.

The cap has an opening 60 which upon rotation of the cap may be presented progressively in registry with the time for taking indicia and dispensing on the top of the housing. Markings are also provided to indicate the direction of rotation and dosage indication. The opening thus serves as both a sight opening and dispensing opening.

Figure 6:
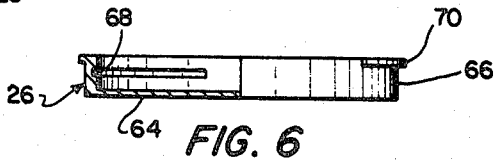
FIG. 6 is a full bodied view in side elevation of a right half of the bottom fill cap with the left hand half being shown in vertical section on a radius of the fill cap.
Figure 8:
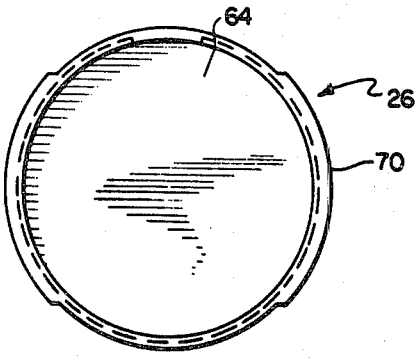
FIG. 8 is a top plan view of the bottom fill cap.
Figure 9:
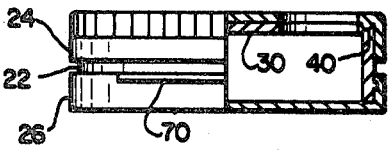
FIG. 9 is a full bodied view in side elevation of the left side of the pill box with the right hand side being shown in vertical section on a radius thereof showing the engagement of the detent means.
Figure 10:
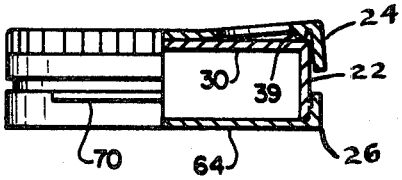
FIG. 10 is a view similar to FIG. 9 but showing the partial rotation of the cap between detent engagement stages.

The bottom fill cap 26 is best shown in FIGS. 6 and 8. It is comprised of a flat bottom wall 64 and a short skirt or side wall 66 adapted to snugly engage the bottom of the housing. An internal groove 68 is provided to engage the lower bead 36 of the housing. Tabs 70 are engageable by the user to snap the fill cap on and off in the filling operation.

A modified pill dispenser of this invention is generally indicated by the reference numeral 80 in FIGS. 12, 14, 15 and 19. It is comprised of a housing 82, a top cap 84 and a fill cap 86.

Figure 16:
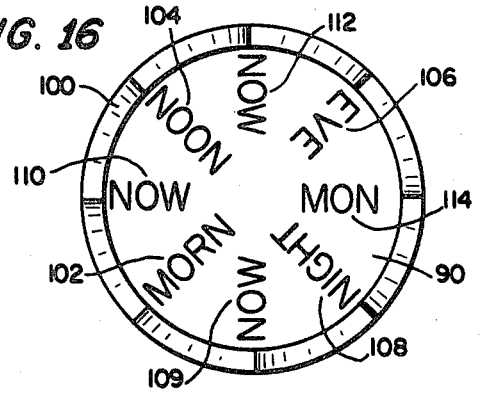
FIG. 16 is a top plan view of the box housing of the modification of FIG. 13 with the top and bottom removed.
Figure 17:
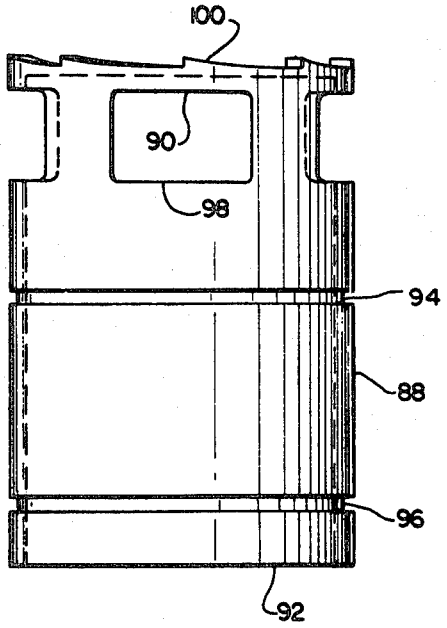
FIG. 17 is a view in side elevation of the housing of the modification of FIG. 13.

The housing is best shown in FIGS. 16 and 17 and is comprised of a tubular side wall 88 having a closed top wall 90 and an open bottom 92 to provide easy access for filling.

The housing side wall has an upper groove 94 for press-fitting and securing of the cap as will appear more fully hereinbelow. A lower groove 96 is similarly provided to receive the bottom fill cap.

The side wall is further provided with a series of four circumferential openings 98 at a top portion of the housing. Each of the openings is associated with the period of time for dispensing the pills when the lid or cap is turned.

In order to provide for one-way turning of the lid upon the housing a ring of ratchet teeth 100 is provided on the top wall as shown in FIG. 17. These ratchet teeth engage with ratchet teeth on the lid as will appear hereinbelow to ensure that the lid may be turned only in a sequential clockwise manner through the time periods in the dosage cycle.

The top wall as shown in FIG. 16 has marked upon it indicia corresponding to the time for taking and for purpose of example the indicia are indicated as MORN at 102, NOON at 104, EVE at 106 and NIGHT at 108. Spaced clockwise sequentially from the aforementioned indicia are further markings NOW at 110, NOW at 112, NOW at 114 and NOW at 116. Each of the NOW indicia are radially aligned with one of the openings 100 in order to ensure that upon the proper turning of the lid, as will be more fully described, a pill may be dispensed therethrough. It will be understood that the number of side wall openings in the housing and associated indicia may be varied in the fabrication of the housing depending on the number of pill taking periods in a complete cycle whether this be a day, week or month or the like.

Figure 18:
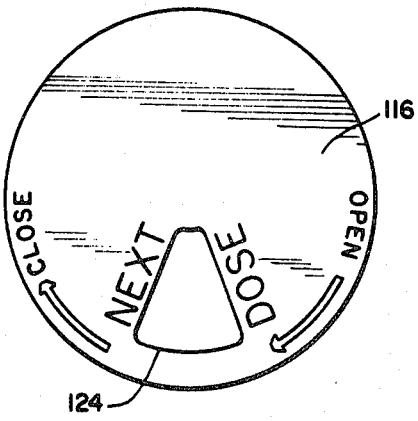
FIG. 18 is a top plan view of the removable top of the modification of FIG. 13.
Figure 19:
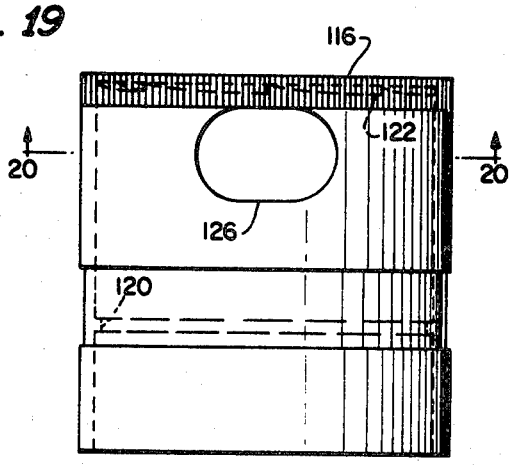
FIG. 19 is a view in side elevation of the top of the modification of FIG. 13.
Figure 20:
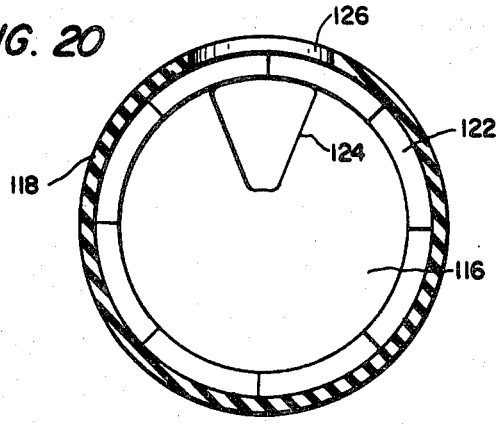
FIG. 20 is a view in section of the modification taken on the line of FIG. 19.

The turn cap 84 is best shown in FIGS. 18 and 19. It is comprised of a top wall 116 and downwardly depending side wall or skirt 118 which forms a loose fit over the top of the housing in order that rotation may be effected. An internal bead 120 is adapted to engage in the upper groove 94 of the housing to effect a snap-on or press-on fit.

A ring of ratchet teeth 122 is formed on the underside of the top wall in registry and engageable with the ratchet teeth of the housing as shown in FIG. 19. By means of this ratchet tooth engagement the cap may be easily turned in a clockwise direction in the pill dispensing operation.

The cap has a sight opening 124 in registry with the time taking indicia on the top of the housing. Markings are also provided to indicate the direction of rotation and dosage indication.

The cap has a single opening 126 on the side wall or skirt. This opening is adapted to provide registry with a single opening in the housing as the cap is turned in the sequential dispensing operation. The opening is in radial registry with the aforementioned sight opening to provide the aligned openings when the cap is turned to expose the NOW indicia.

Figure 22:
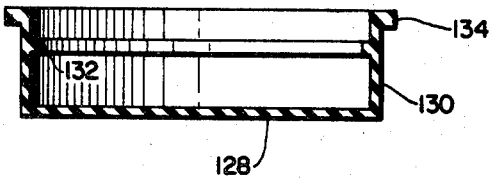
FIG. 22 is a view in section of the modification taken on the line 22—22 of FIG. 21.
Figure 21:
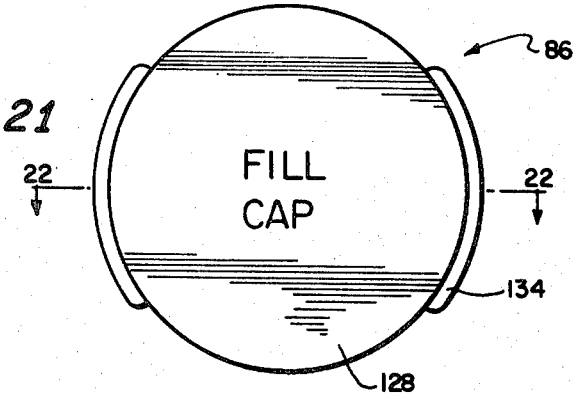
FIG. 21 is a bottom plan view of the removable bottom or fill cap of the modification of FIG. 13.

The fill cap 86 is best shown in FIGS. 21 and 22. It is comprised of a flat bottom wall 128 and a skirt or side wall 130 adapted to snugly engage the bottom of the housing. An internal bead 132 is provided to engage the lower groove 96 of the housing. Tabs 134 are engageable by the user to snap the fill cap on and off in the filling operation.

USE

The pill dispenser 20 is simply employed by a user for progressive dispensing and medication of this time for taking. The dispenser may be provided with a self-adhesive label indicating the dosage time and amount which the user can affix to the side of the housing to set the turn cap to the proper time.

When the time occurs for taking a pill such as morning when the turn cap 24 has been turned to expose the MORN indicia 42 the user turns the cap clockwise to the next dispensing position to align the opening 60 in the cap with the next dispensing opening 38 in the housing. These positions are easily viewed through the opening 60 which serves both as a dispensing opening and a sight window. When the cap dispensing opening 60 is aligned with the housing opening the pill or pills are dispensed.

The user then turns the cap to the next period for taking the next pill. If the next period is noon the cap is turned to the NOON 44 position. Should the next period be later such as NIGHT or BED, the user simply turns the cap to this position and when the time arrives the cap is turned in the previous fashion to the next dispensing position.

All of the pill taking operations are carried out in a simple and efficient manner. The user enjoys the advantage in use of the pill dispenser of this invention in being always aware when the next time or period for taking the pill is while the dispenser is closed and can not be disposed until turned to the next dispensing position.

The fill cap 26 is simply employed by the pharmacist in the initial fill operation or by the user or for refills as the need occurs. The tabs 70 provide for easy grasping or prying the cap from engagement with the housing. A pry tool such as a coin, screwdriver or the like may also be used between the opposed wall or skirt edges of the medication cap and the fill cap to pry the fill cap apart from the housing. The cap is simply snapped back on by engagement of the inner groove of the cap with the bead on the dispenser housing. Through the provision of the bottom fill cap interference or tampering with the top turn cap structure is also avoided.

The modified pill dispenser 80 is similarly employed by a user.

When the time occurs such as morning when the turn cap 84 has been turned to expose the MORN indicia the user turns the cap clockwise to the NOW 110 position. These positions are easily viewed through the sight window 124. In the NOW 110 position the cap dispensing opening 126 is aligned with a housing opening 98 and the pill or pills are dispensed.

The user then turns the cap to the next period for taking the next pill. If the next period is noon the cap is turned to the NOON 104 position. Should the next period be later such as evening or night, the user simply turns the cap to this position and when the time arrives for actual taking the cap is turned in the previous fashion to the next NOW position.

All of the pill taking operations are carried out in a simple and efficient manner. The user enjoys the advantage in use of the pill dispenser of this invention in being always aware when the next time or period for taking the pill is while the dispenser is closed and can not be dispensed until turned to the next NOW position. The fill cap 86 is simply employed by the pharmacist in the initial fill operation or by the user or for refills as the need occurs in the same manner as previously described.

Through the simple plastic construction of the various parts of the dispenser an inexpensive dispenser that is rugged and efficient has been effected. The dispenser as will readily appear can be used by the infirm and forgetful as well as the able-bodied with ease and little likelihood of misuse which is of great advantage where the consequences of misuse are obvious. The dispenser may be varied in size to lengthen or shorten the overall height to the lower profile where desired to fit easily in a lady's purse. Likewise, the number of time taking openings may be varied depending on the number of time taking periods to make up a repetitive cycle.

Various changes and modifications may be made in this invention as will be readily apparent to those skilled in the art. Such changes and modifications are within the scope and teaching of this invention as defined in the claims appended hereto.

What is claimed is:

1. A pill dispenser having provisions for sequential dispensing operation, said dispenser being comprised of a cylindrical integral hollow housing constituting a reservoir for pills cooperating with a fill cap and a turn cap, said housing having a top wall bridging a circumferential downwardly extending side wall, said housing being provided with a plurality of circumferential housing openings and a plurality of first ratchet means, said turn cap rotatably seated on top of said housing, said cap being provided with a cap opening and a plurality of second ratchet means circumferentially arranged on an inner surface of said turn cap, said first and second ratchet means coacting so as to facilitate unidirectional registering of said cap opening with a selected one of said housing openings, indicia on the top wall of the housing corresponding to designate separate times for dispensing said pills, said indicia being positioned between said housing openings to provide a separate time indicia for dispensing in advance of each of said openings, said cap being rotatable in one direction through said ratchet means to progressively present the cap opening in registry with the indicia on the housing and the housing openings.

2. The pill dispenser of claim 1 in which the turn cap and housing are rotatably engageable with one another through detent means to provide a selective stagewise positioning of the cap with respect to said housing by said coacting ratchet means.

3. The pill dispenser of claim 2 in which a first one of a mating wall surface of the cap and the housing is provided with a bead-like detent member selectively engageable with detent openings in the other of said mating wall surfaces.

4. The pill dispenser of claim 1 in which the cap opening means comprises an opening in the top wall of the cap adapted to expose said indicia, said housing openings being spaced from one another on the top wall of the housing, said cap opening being progressively registrable with said indicia and housing openings as the cap is rotated.

5. The pill dispenser of claim 1 in which the cap opening means comprises a sight opening in a top wall of the cap adapted to expose said indicia, said housing openings being spaced from one another on the side wall of said cap and separated from one another by solid wall portions of said side wall in registry with said indicia, said top wall of the housing being further provided with ready to dispense indicia indicating the dispenser is ready to dispense, said ready to dispense indicia being in radial registry with said side wall dispensing openings, said cap opening means further including a dispensing opening in radial alignment with said sight opening, said cap dispensing opening being progressively registrable as the cap is rotated with said housing openings when the cap is turned to expose the ready to dispense indicia with the sight opening.

6. The pill dispenser of claim 5 in which the ready to dispense indicia are alternately spaced on the top wall of the housing with the time of taking indicia.

7. The pill dispenser of claim 1 in which the housing has a bottom fill opening and said fill cap is provided removably engageable with the side walls of said housing.

8. The pill dispenser of claim 7 in which said fill cap has a side wall closely engageable with the side wall of the housing, one of said walls having an inner circumferential bead engageable with an exterior groove of the other said side wall to provide securing means.

9. The pill dispenser of claim 8 in which said bead and groove extend only partially around the fill cap and the housing and tab means are provided on said fill cap to facilitate disengagement of the cap with respect to said housing.

10. The pill dispenser of claim 9 in which the housing has a relatively short height compared to the diameter of said housing to provide a compact housing with a low profile and the side walls of said turn cap and fill cap each have a circumferential edge closely adjacent to one another to receive a pry tool such as a coin or the like to pry said cap apart from the housing.

11. The pill dispenser of claim 1 in which the side wall of the turn cap fits slidably over the side wall of the housing, one of said side walls having an inner circumferential bead engageable with an exterior groove of the side wall of the other side wall to provide securing means.

12. The pill dispenser of claim 11 in which the ratchet means is comprised of a circumferential ring of ratchet teeth on the top wall of the housing engageable with a circumferential ring of ratchet teeth on the underside of said turn cap, the housing has a bottom fill opening and a fill cap is provided removably engageable with the side wall of said housing.

13. The pill dispenser of claim 12 in which the side wall of the turn cap fits slidably over the side wall of the housing and one of said side walls has an inner circumferential bead engageable with an exterior groove of the other said side wall to provide securing means and said fill cap has a side wall closely engageable with the side wall of the housing and one of said last named side walls has an inner circumferential bead engageable with an exterior groove of the other of said last named side walls to provide securing means.

14. The pill dispenser of claim 13 in which the housing has a relatively short height compared to the diameter of said housing to provide a compact housing with a low profile and the side walls of said turn cap and fill cap each have a circumferential edge closely adjacent to one another to receive a pry tool such as a coin or the like to pry said fill cap apart from the housing.

15. The pill dispenser of claim 1 in which the ratchet means is comprised of a circumferential ring of ratchet teeth on the top wall of the housing engageable with a circumferential ring of ratchet teeth on the underside of said turn cap.

16. A pill dispenser having provisions for sequential dispensing operation, said dispenser being comprised of a cylindrical integral hollow housing constituting a reservoir for pills cooperating with a fill cap and a turn cap, said housing having a top wall bridging a circumferential downwardly extending side wall, said housing being provided with a plurality of circumferential housing openings and a plurality of first detent means, said turn cap rotatably seated on top of said housing, said cap being provided with a cap opening and a plurality of second detent means circumferentially arranged on an inner surface of said turn cap, said first and second detent means coacting so as to facilitate unidirectional registering of said cap opening with a selected one of said housing openings, indicia on the top wall of the housing corresponding to designate separate times for dispensing said pills, said indicia being positioned between said housing openings to provide a separate time indicia for dispensing in advance of each of said openings, said cap being rotatable in one direction through said detent means to progressively present the cap opening in registry with the indicia on the housing and the housing openings.

* * * * *